United States Patent [19]

Robertson

[11] Patent Number: 4,944,389

[45] Date of Patent: Jul. 31, 1990

[54] METHOD OF ASSEMBLING EARRING AND DISPLAY CARD ASSEMBLY AND ASSEMBLY THEREBY FORMED

[75] Inventor: Edward I. Robertson, North Providence, R.I.

[73] Assignee: E. D. R. Industries, Inc., Providence, R.I.

[21] Appl. No.: 453,770

[22] Filed: Dec. 20, 1989

[51] Int. Cl.[5] ..... B65D 73/00

[52] U.S. Cl. ..... 206/6.1; 53/397; 53/448; 206/566; 206/477; 206/486; 206/45.14

[58] Field of Search ..... 53/397, 448; 206/6.1, 206/486, 566, 45.14, 487, 480, 477

[56] References Cited

U.S. PATENT DOCUMENTS

| | | | |
|---|---|---|---|
| 2,472,532 | 6/1949 | Hellman | 206/488 |
| 4,099,611 | 7/1978 | Feibelman | 206/490 |
| 4,432,456 | 2/1984 | Ovadia et al. | 206/566 |
| 4,606,458 | 8/1986 | LaBate | 206/486 X |
| 4,718,554 | 1/1988 | Barbato | 206/486 |
| 4,821,883 | 4/1989 | Miller | 206/486 X |

*Primary Examiner*—William Price
*Attorney, Agent, or Firm*—Salter & Michaelson

[57] ABSTRACT

An earring and display card assembly includes a display card having at least one aperture therein and a plurality of resilient fingers which are defined by slits which radiate outwardly from the aperture and an earring assembly including an ornament member, a post extending rearwardly from the ornament member and a clutch on the post. The earring and display card assembly is formed by inserting the post of the earring assembly into the aperture in the display card with the clutch thereon, and advancing the post rearwardly so that the resilient fingers are deflected rearwardly to receive the clutch.

16 Claims, 1 Drawing Sheet

METHOD OF ASSEMBLING EARRING AND DISPLAY CARD ASSEMBLY AND ASSEMBLY THEREBY FORMED

BACKGROUND AND SUMMARY OF THE INVENTION

The instant invention relates to ornamental jewelry and more particularly to an earring and display card assembly and to a method of assembling an earring assembly on a display card.

Jewelry display cards have generally been found to be effective for packaging and displaying ornamental jewelry articles, such as earrings of the type which are adapted for use on pierced-ears. In this regard, most jewelry display cards generally comprise a substantially flat card portion having at least one aperture therethrough and means for hanging the card portion from a display stand or hanger. For use of a display card of this type for displaying an earring, the post of the earring is passed through the aperture in the card portion and a clutch or the like is assembled with the post on the rear side of the card portion. The display card can then be suspended from a display stand or hanger so that the earring is attractively displayed in front of the front side of the card portion. Further, when the card portion of a display card of this type is adapted to accommodate a pair of earrings, the earrings can be displayed together on the card portion so that they are retained in a pair and not easily inadvertently separated from one another.

Unfortunately, however, while jewelry display cards have generally been found to be effective for packaging and displaying ornamental jewelry items, such as earrings and the like, the heretofore available procedures for assembling ornamental jewelry items, such as earrings and the like, on display cards have been found to be relatively labor intensive. This is because, in most instances, the heretofore available assembly procedures have not been adapted for automated assembly techniques but rather they have required time consuming, labor intensive manual assembly procedures. Specifically, in most instances heretofore it has been necessary to assemble earrings on display cards by manually inserting the posts of the earrings through apertures in the display cards and by thereafter manually assembling clutches on the posts. This has been found to be a relatively costly and time consuming assembly operation but because of the overall effectiveness of display cards for displaying jewelry items, such as earring and the like, it has nevertheless been the accepted practice for assembling earrings on display cards.

It has now been found that by providing slits which radiate outwardly from the apertures in a jewelry display card it is possible to assemble earrings or the like having clutches preassembled thereon onto the display card. It has been further found that as a result for the first time it is possible to assemble a pair of earrings and clutches on a display card in an entirely automated assembly operation. Specifically, it has been found that it is possible to assemble a clutch on the post of a pierced-earring in an automated assembly operation and to then assemble the earring-clutch assembly with a display card in a second automated assembly operation. In particular, the second assembly operation is carried out by inserting the post of the earring into the aperture in the display card so that the clutch causes the fingers defined by the slits around the aperture to be deflected rearwardly as the clutch is passed at least partially through the aperture.

Accordingly, the method of the instant invention is operative for assembling an earring assembly on a display card. The earring assembly comprises an ornament member having front and rear sides, a post extending rearwardly from the rear side of the ornament member, and a clutch which is received and releasably frictionally retained on the post. The display card includes a substantially flat card member having a reduced aperture therein and a plurality of slits which radiate outwardly from the aperture to define a plurality of resilient fingers therearound. The aperture is dimensioned for normally receiving the post therethrough but not the clutch, although the fingers around the aperture are rearwardly deflectable for receiving the post with the clutch thereon through the aperture. The method comprises the step of passing the post with the clutch thereon through the aperture from the front side of the card member to position at least a portion of the clutch on the rear side of the card member. The clutch preferably comprises a substantially cylindrical tubular sleeve and in one form of the method it is assembled with the display card so that the fingers on the card engage the longitudinal periphery of the clutch to retain the earring assembly on the display card. In another form of the method the earring assembly further includes a bushing member of reduced diameter on the post between the clutch and the ornament member and the earring assembly is assembled with the display card so that the fingers on the display card engage the bushing member to retain the earring assembly in a predetermined orientation on the display card.

The earring and display card assembly of the instant invention which is preferably made by the above described method comprises a card portion including a substantially flat card member having front and rear sides, the card member having a reduced aperture therein and a plurality of slits which radiate outwardly from the aperture to define a plurality of resilient fingers therearound, and an earring assembly portion including an ornament member having front and rear sides, a post extending rearwardly from the rear side of the ornament member and a clutch received and releasably frictionally retained on the post. The aperture in the card member is dimensioned to normal receive the post therethrough but not the clutch, although the fingers are rearwardly deflectable for receiving the post with the clutch thereon through the aperture. The earring assembly is assembled with the card member so that the post extends through the aperture with the ornament member disposed on the front side of the card member and at least a portion of the clutch disposed on the rear side of the card member. The clutch is preferably of substantially tubular cylindrical configuration and in one embodiment of the earring and display card assembly the clutch is disposed entirely on the rear side of the card member. In another embodiment of the earring and display card assembly the earring assembly further comprises a bushing member which is received on the post between the clutch and the ornament member. In this embodiment the bushing member is of greater dimension than the aperture but of smaller dimension than the clutch and it is received in the aperture so that the fingers engage the bushing member to retain the earring assembly in a predetermined orientation on the display card.

Accordingly, it is a primary object of the instant invention to provide an effective method of assembling an earring assembly on a display card.

Another object of the instant invention is to provide a method of assembling an earring assembly on a display card, which method is adapted for automated assembly techniques.

An even further object of the instant invention is to provide an effective earring and display card assembly which can be assembled by automated assembly techniques.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
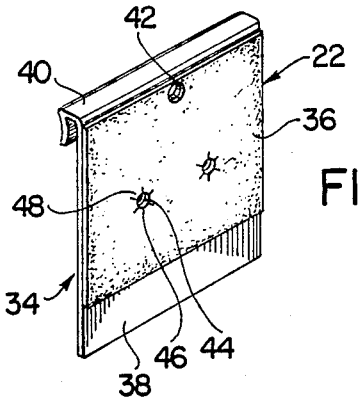
FIG. 1 is a perspective view of the display card of the instant invention prior to assembling an earring assembly therewith.
Figure 2:
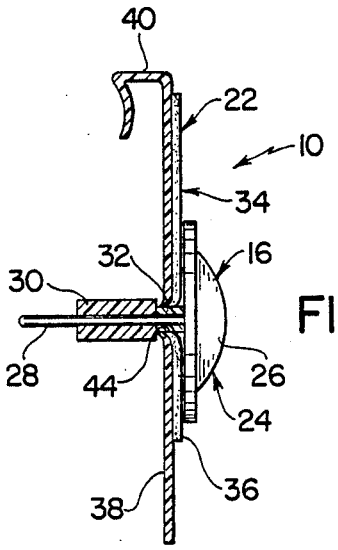
FIG. 2 is a sectional view of a first embodiment of the earring and display card assembly.
Figure 3:
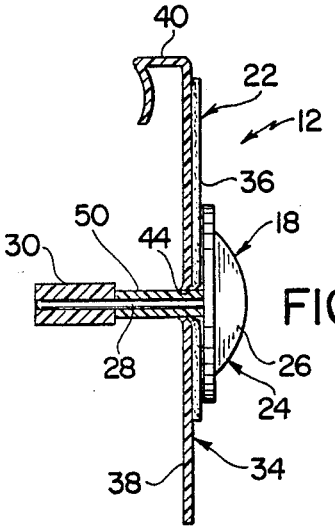
FIG. 3 is a sectional view of a second embodiment thereof.
Figure 4:
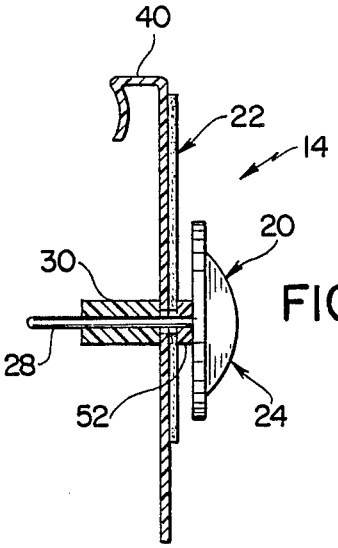
FIG. 4 is a sectional view of a third embodiment thereof.

Referring now to the drawing, first, second, and third embodiments of the earring and display card assembly of the instant invention are illustrated in FIGS. 2, 3 and 4, respectively, and generally indicated at 10, 12 and 14, respectively. The earring and display card assemblies 10, 12 and 14 comprise pairs of earring assemblies 16, 18 and 20, respectively, and they each comprise a display card generally indicated at 22. The earring and display card assemblies 10, 12 and 14 are adapted to be made by automated assembly techniques and they are preferably assembled in accordance with the method of the instant invention as will hereinafter be more fully set forth.

Referring first to the earring and display card assembly 10 illustrated in FIG. 2, the earring assembly 16 comprises a pair of conventional pierced-earrings, each of which is generally indicated at 24 and each of which includes an ornament member 26, and an elongated post 28. Each of the posts 28 is preferably made from a hypoallergenic surgical steel and each is secured to the ornament member 26 thereof so that it extends rearwardly from the rear side of the ornament member 26 thereof as illustrated. Assembled on each of the posts 28 is a clutch 30 and a bushing member 32. Each of the clutches 30 is preferably made from an elastomeric material in a substantially cylindrical tubular configuration and each is releasably resiliently frictionally retained on the post 28 thereof. Each of the bushing members 32 is preferably also made from an elastomeric material in a tubular cylindrical configuration, although the bushing members 32 preferably have somewhat smaller diameters than the clutches 30. Each of the bushing members 32 is assembled on the post 28 thereof between the clutch 30 thereof and the ornament member 26 thereof. The display-card 22 preferably comprises a main portion 34 which is extruded from a suitable plastic material, such as a vinyl plastic and a decorative facing 36. The main portion 34 preferably includes a substantially flat card portion 38 and a hanger portion 40 which extends rearwardly and then downwardly from the upper edge of the card portion 38. The decorative facing 36 is preferably made from a decorative flocked material so that it provides an attractive background for the ornament members 26 and it is secured to the front side of the card portion 38 as illustrated. Extending through the card portion 38 and the decorative facing 36 is an aperture 42 and a pair of spaced reduced apertures 44 extends through the facing 36 and the main card member 38 in downwardly spaced relation to the hanger portion 40. The apertures 44 have radially extending slits 46 therearound which define radially inwardly extending fingers 48 and they are dimensioned for receiving the posts 28 therethrough but not the bushings 32 or the clutches 30. However, the slits 46 are formed so that the fingers 48 have sufficient lengths to enable them to be deflected rearwardly to permit both the clutches 30 and the bushings 32 to be passed through the apertures 44. Accordingly, the assembly 10 is preferably constructed by first assembling the bushings 32 and the clutches 30 on the posts 28 thereof and by thereafter inserting the posts 28 into the apertures 44 so that the clutches 30 deflect the fingers 48 rearwardly to permit the clutches 30 and the bushings 32 to be passed through the apertures 44 until the fingers 48 engage the bushings 32 as illustrated.

The earring and display card assembly 12 is illustrated in FIG. 3 and it comprises a display card 22 and a pair of earring assemblies 18. The earring assemblies 18 each include an earring 24 including an ornament member 26 and a post 28, a bushing 50 and a clutch 30. The clutches 30 are substantially identical to the clutches 30 in the earring and display card assembly 10. However, the bushings 50 are of increased length so that the combined length of each bushing 50 and clutch 30 pair is at least slightly greater that the length of the post 28 thereof. Accordingly, the bushings 50 and the clutches 30 cooperate to cover substantially the entire longitudinal peripheries of the posts 28. This enables the bushings 50 and the clutches 30 to be assembled onto the posts 28 prior to immersing the earring assemblies 18 into a plating bath since the bushings 50 and the clutches 30 prevent plating materials from being plated onto the surgical steel posts 28. In any event, the posts 28 and the earring assemblies 18 are dimensioned so that they are receivable through the apertures 44. The bushings 50 and the clutches 30, on the other hand, are dimensioned so that they are not normally receivable through the apertures 44 without deflecting the fingers 48 rearwardly. The earring assemblies 18 are preferably assembled with the cards 34 by passing the clutches 30 and the terminal portions of the posts 28 through the apertures 44 so that the fingers 48 are deflected rearwardly until the fingers 48 engage the outer peripheries of the bushings 50.

Referring now to FIG. 4 the earring and display card assembly 14 is illustrated. The assembly 14 comprises a pair of earring assemblies 20 and a display card 22. The earring assemblies 20 comprise pierced earrings 24, each including an ornament member 26 and a post 28, a clutch 30 and a bushing 52. The bushings 52 are of substantially the same diameter as the clutches 30 and they are received on the posts 28 so that they are spaced forwardly slightly from the clutches 30. The posts 28 are dimensioned so that they are receivable through the apertures 44. However, the clutches 30 and the bushings 52 are dimensioned so that they are not normally receivable through the apertures 44 without deflecting the fingers 48 rearwardly. The earring assemblies 20 are assembled on the card 22 so that the fingers 48 are deposed between the clutches 30 and the bushings 52 so that the clutch 30 and the bushing 52 cooperate to position the earring assemblies 20 in predetermined orientations on the card 22. In this regard, the earring assemblies 20 are preferably assembled on the card 22 by inserting the posts 28 thereof into the apertures 44 and by then pushing the earring assemblies rearwardly so that the clutches 30 deflect the fingers 48 rearwardly to allow the clutches 38 to be received through the apertures 44 until the fingers 48 are received between the clutches 30 and the bushings 52.

It is seen therefore that the instant invention provides an effective method of assembling an earring assembly on a display card and that it also provides an effective earring and display card assembly. The earring assemblies 16, 18 and 20 can be effectively and easily assembled on their respective cards 22 by automated assembly techniques because the slits 46 around the apertures 44 allow the fingers 48 to be deflected rearwardly for receiving the clutches 3 and the bushings 32 and 50. Further, once the earring assemblies 16, 18 and 20 have been assembled on their respective cards 22 the fingers 48 effectively position the earring assemblies 16, 18 and 20 in desired orientations on their respective cards 22. Accordingly, it is seen that the method and earring and display card assembly of the instant invention represent significant advancements in the jewelry art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An earring and display card assembly comprising a card portion including a substantially flat card member having front and rear sides, said card member having a reduced aperture therethrough and a plurality of slits which radiate outwardly from said aperture to define a plurality of resilient fingers therearound, and an earring portion including an ornament member having front and rear sides, a post extending rearwardly from said ornament member and clutch means received and releasably frictionally retained on said post, said aperture being normally dimensioned to receive said post therethrough but not said clutch means, said fingers being rearwardly deflectable for receiving said post with said clutch means thereon through said aperture, said earring portion being assembled with said card member so that said post extends through said aperture with said ornament member disposed on the front side of said card member and at least a portion of said clutch means disposed on the rear side of said card member.

2. In the earring and display card assembly of claim 1, said clutch means being of tubular substantially cylindrical configuration.

3. In the earring and display card assembly of claim 2, said clutch means being disposed entirely on the rear side of said card member.

4. The earring and display card assembly of claim 3, further comprising a tubular bushing member received on said post between said clutch means and said ornament member, said bushing member normally being of greater dimension than said aperture but being receivable through said aperture by deflecting said fingers rearwardly.

5. In the earring and display card assembly of claim 4, said bushing member being received in said aperture, said fingers being deflected rearwardly slightly and engaging the longitudinally extending periphery of said bushing member to retain said earring portion in a predetermined orientation on said card portion.

6. In the earring and display card assembly of claim 5, said bushing member and said clutch means cooperating to cover the entire longitudinally extending periphery of said post.

7. A method of assembling an earring assembly on a display card, said earring assembly including an ornament member having front and rear sides, a post extending rearwardly from the rear side of said ornament member and clutch means received and releasably frictionally retained on said post, said display card including a substantially flat card member having a reduced aperture therein and a plurality of slits which radiate outwardly from said aperture to define a plurality of resilient fingers therearound, said aperture being normally dimensioned to receive said post therethrough but not said clutch means, said fingers being rearwardly deflectable for receiving said post with said clutch means thereon through said aperture, said method comprising the step of passing said post with said clutch means thereon through said aperture from the front side of said card member to position at least a portion of said clutch means on the rear side of said card member.

8. In the method of claim 7, said earring assembly further comprising a tubular bushing member on said post between said clutch means and said ornament member, said bushing member being of smaller sectional dimension than said clutch means, said earring assembly being assembled with said display card so that said fingers engage said bushing member to retain said earring assembly in a predetermined orientation on said display card.

9. In the method of claim 7, said clutch means further characterized as a substantially cylindrical tubular sleeve.

10. In the method of claim 8, said clutch means further characterized as a substantially cylindrical tubular sleeve.

11. In the method of claim 8, said earring assembly being assembled with said display card so that said fingers are engaged interposed between said clutch means and said bushing member.

12. In the method of claim 11, said clutch means comprising an elongated tubular sleeve, said earring assembly being assembled with said display card so that said fingers engage the longitudinal periphery of said sleeve.

13. An earring and display card assembly comprising a card portion including a substantially flat card member having front and rear sides, said card member having a reduced aperture therethrough and a plurality of slits which radiate outwardly from said aperture to define a plurality of resilient fingers therearound, and an earring portion including an ornament member having front and rear sides, a post extending rearwardly from said ornament member and a tubular bushing member received and releasably frictionally retained on said post, said aperture being normally dimensioned to receive said post therethrough but not said bushing member, said fingers being rearwardly deflectable for receiving said post with said bushing member thereon through said aperture, said earring portion being assembled with said card member so that said post extends through said aperture with said ornament member disposed on the front side of said card member and at least a portion of said bushing member disposed on the rear side of said card member.

14. In the earring and display card assembly of claim 1, said bushing member being of elongated substantially cylindrical configuration.

15. A method of assembling an earring assembly on a display card, said earring assembly including an ornament member having front and rear sides, a post extending rearwardly from the rear side of said ornament member and a tubular bushing member received and releasably frictionally retained on said post, said display card including a substantially flat card member having a reduced aperture therein and a plurality of slits which radiate outwardly from said aperture to define a plurality of resilient fingers therearound, said aperture being normally dimensioned to receive said post therethrough but not said bushing member, said fingers being rearwardly deflectable for receiving said post with said bushing member thereon through said aperture, said method comprising the step of passing said post with said bushing member thereon through said aperture from the front side of said card member to position at least a portion of said bushing member on the rear side of said card member.

16. In the method of claim 7, said bushing member further characterized as an elongated substantially cylindrical tubular sleeve.

* * * * *